US006851990B2

(12) United States Patent
Hassan et al.

(10) Patent No.: US 6,851,990 B2
(45) Date of Patent: Feb. 8, 2005

(54) METHOD AND DEVICE FOR LOW-NOISE UNDERWATER PROPULSION

(75) Inventors: Ahmed A. Hassan, Mesa, AZ (US); David B. Domzalski, Gilbert, AZ (US); Ram D. JanakiRam, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/323,105

(22) Filed: Dec. 18, 2002

(65) Prior Publication Data

US 2004/0121662 A1 Jun. 24, 2004

(51) Int. Cl.[7] ..... B63H 11/00
(52) U.S. Cl. ..... 440/38; 440/18
(58) Field of Search ..... 440/38, 6, 13, 440/16–18; 472/14; 446/162, 163

(56) References Cited

U.S. PATENT DOCUMENTS 1,281,643 A * 10/1918 Olsen ..... 440/18
3,556,039 A * 1/1971 Sfredda ..... 440/17
5,366,395 A * 11/1994 Mostaghel et al. ..... 440/17
5,813,625 A 9/1998 Hassan et al.
5,938,404 A 8/1999 Domzalski et al.
6,092,990 A 7/2000 Hassan et al.
6,234,751 B1 5/2001 Hassan et al.
6,471,477 B2 10/2002 Hassan et al.
6,543,719 B1 4/2003 Hassan et al.

* cited by examiner

*Primary Examiner*—Jesus D. Sotelo
(74) *Attorney, Agent, or Firm*—Thompson Coburn LLP

(57) ABSTRACT

A method and apparatus is disclosed for producing propulsion underwater with minimal acoustical emission. In basic concept, the method comprises the expulsion and sucking of liquid into and out of a liquid port of a watercraft in a manner generating compression and expansion waves adjacent the liquid port. Such expansion and compression waves generate a positive net thrust on the watercraft in a direction opposite that of their expulsion. A reciprocating member and an actuator are also disclosed for generating the forces and energy necessary to create the expansion and compression waves.

18 Claims, 4 Drawing Sheets

METHOD AND DEVICE FOR LOW-NOISE UNDERWATER PROPULSION

BACKGROUND OF THE INVENTION

Various types of propulsion devices are known for propelling watercraft through water environments. Such types of propulsive devices include types that push water, push air, and that are propelled by other means, such as by rocket. This invention pertains particularly to water pushing propulsion devices.

Various types of water pushing devices have clearly been proven successful and have been utilized for decades and even centuries. Presently, the most common of such devices in use are the exposed rotating propeller and the ducted rotating propeller (the later often being referred to as "jet" propulsion). In most circumstances, the exposed type of propeller is the most efficient and practical means for powering a watercraft. However, in some situations, such as in situations involving a watercraft such as a Jet Ski© or a Wave Runner©, an exposed propeller would present significant risk of personal injury, and therefore a ducted propeller is utilized in place thereof. Although generally less efficient, ducted propellers present significantly less risk of personal injury.

In other situations, such as in military applications in particular, it is desirable to minimize the noise or acoustic signature being emitted from the propulsive device of the watercraft. This is particularly the case with military submersibles, such as manned and unmanned submarines, since acoustic emissions are often the primary way such watercraft are detected. However, watercraft such as fishing boats could also benefit from propulsive devices having reduced acoustic emissions, due to the impact of such emissions on fish. Nonetheless, due to the rotational nature of both exposed propellers and ducted propellers, such propulsion devices inherently produce appreciable acoustic emissions. Furthermore, the turbulence produced by either type of propeller propulsion also produces detectable acoustic emissions. This is the case regardless of whether cavitation occurs, albeit cavitation substantially increases the acoustic emissions. Thus, an alternative means of propelling watercraft, and in particular submersible watercraft, in a manner producing substantially less acoustic emission is desired.

SUMMARY OF THE INVENTION

The inventors of the present invention have developed an entirely new method and apparatus for producing propulsion underwater. This method and apparatus is capable of producing propulsion without rotating parts and without significant noise emissions. Furthermore, the invention in its preferred embodiment is capable of propelling a watercraft without opening and closing valves, without using articulating bearings or bushings, without producing significant turbulence, and without any other means that produces an appreciable acoustic emission signature.

In general, a first method of practicing the invention comprises the steps of providing a watercraft having a liquid chamber and at least one liquid port. The liquid port allows communication of liquid between the liquid chamber and the liquid environment in which the watercraft is traveling through. This method also comprises the step of repetitively increasing and decreasing the internal volume of the liquid chamber in a manner such that liquid is expelled from the liquid port into the liquid environment and the step of propelling the watercraft within the liquid environment via such expulsion of liquid from the liquid port.

A second method of practicing the invention generally comprises the step of providing a watercraft having a main body and a reciprocating member, and providing a water environment external to the watercraft. The water environment is in liquid communication with the reciprocating member of the watercraft. The method further comprises propelling the watercraft through the water via alternating compression and expansion waves created by moving the reciprocating member in a linearly reciprocating manner relative to the main body of the watercraft.

A third method of practicing the invention generally comprises providing a watercraft having one or more liquid chambers and at least one liquid port. The liquid port allows communication of liquid between the liquid chamber and a liquid environment external to the watercraft. The method also comprises expelling liquid from the liquid port into the liquid environment in a manner generating a first thrust on the watercraft in a direction opposite that of the expelled liquid. Yet further, the method comprises sucking liquid into the liquid port from the liquid environment in a manner generating a second thrust on the watercraft in a direction equal to that of the expelled liquid. The second thrust is less than the first thrust in magnitude. Finally, the method further comprises propelling the watercraft within the liquid environment by repetitively performing and alternating the steps of the expelling and the sucking of liquid.

A first apparatus in accordance with the invention comprises a main body, a liquid chamber, a reciprocating member, and a liquid passageway. The liquid chamber contains liquid and the reciprocating member is in communication with the liquid within the liquid chamber. The reciprocating member is also operatively connected to the main body in a manner such that the reciprocating member is linearly movable between first and second positions in a reciprocating manner. The liquid passageway creates a liquid connection between the liquid in the liquid chamber and an environment external to the main body.

While the principal advantages and features of the invention have been described above, a more complete and thorough understanding of the invention may be obtained by referring to the drawings and the detailed description of the preferred embodiment, which follow.

Figure 1:
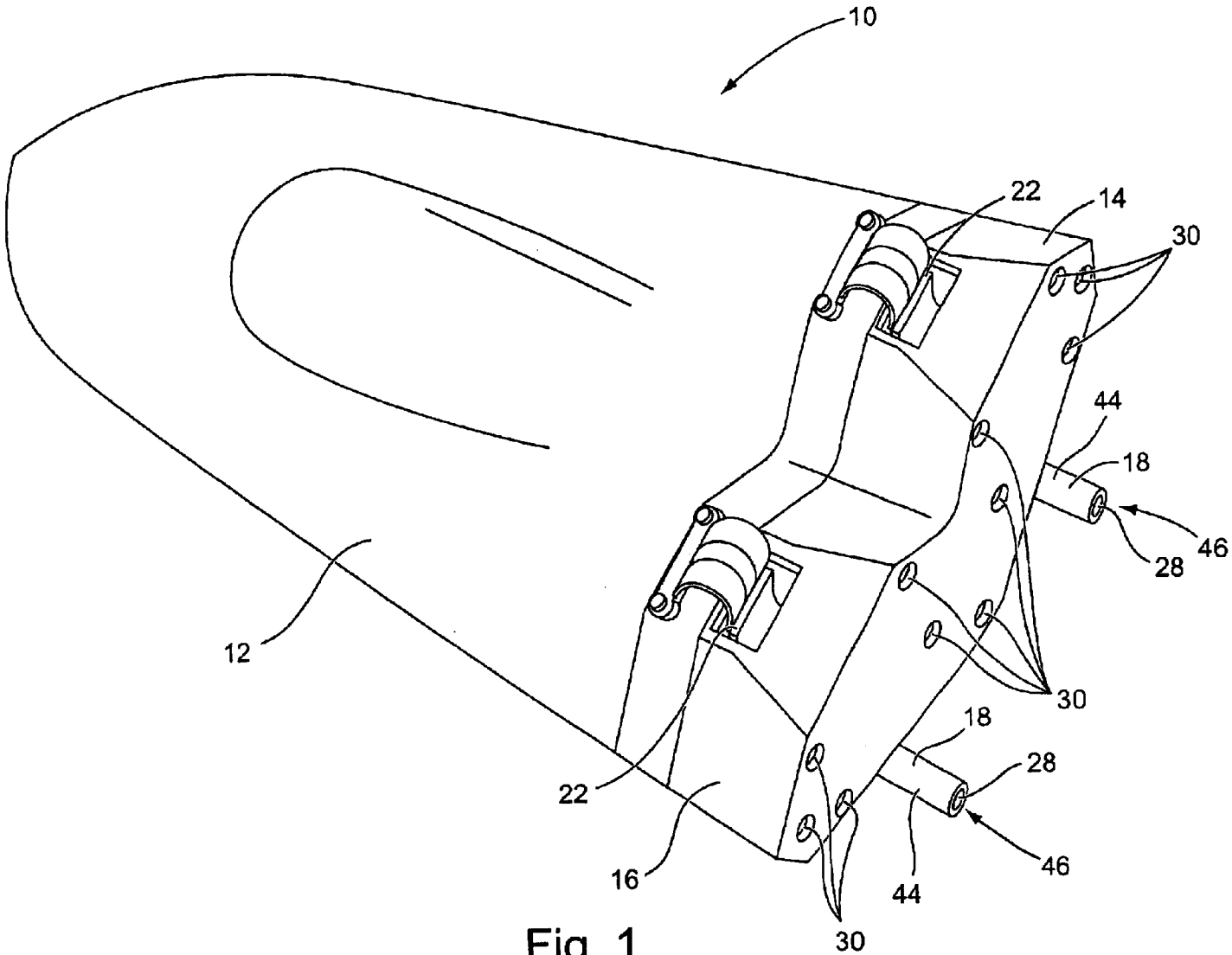
FIG. 1 is perspective view of the watercraft of the preferred embodiment showing the top, rear, and side thereof.

Reference characters in the written specification indicate corresponding items shown throughout the drawing figures.

DETAILED DESCRIPTION OF THE PREFERRED EMBODIMENT OF THE INVENTION

Figure 2:
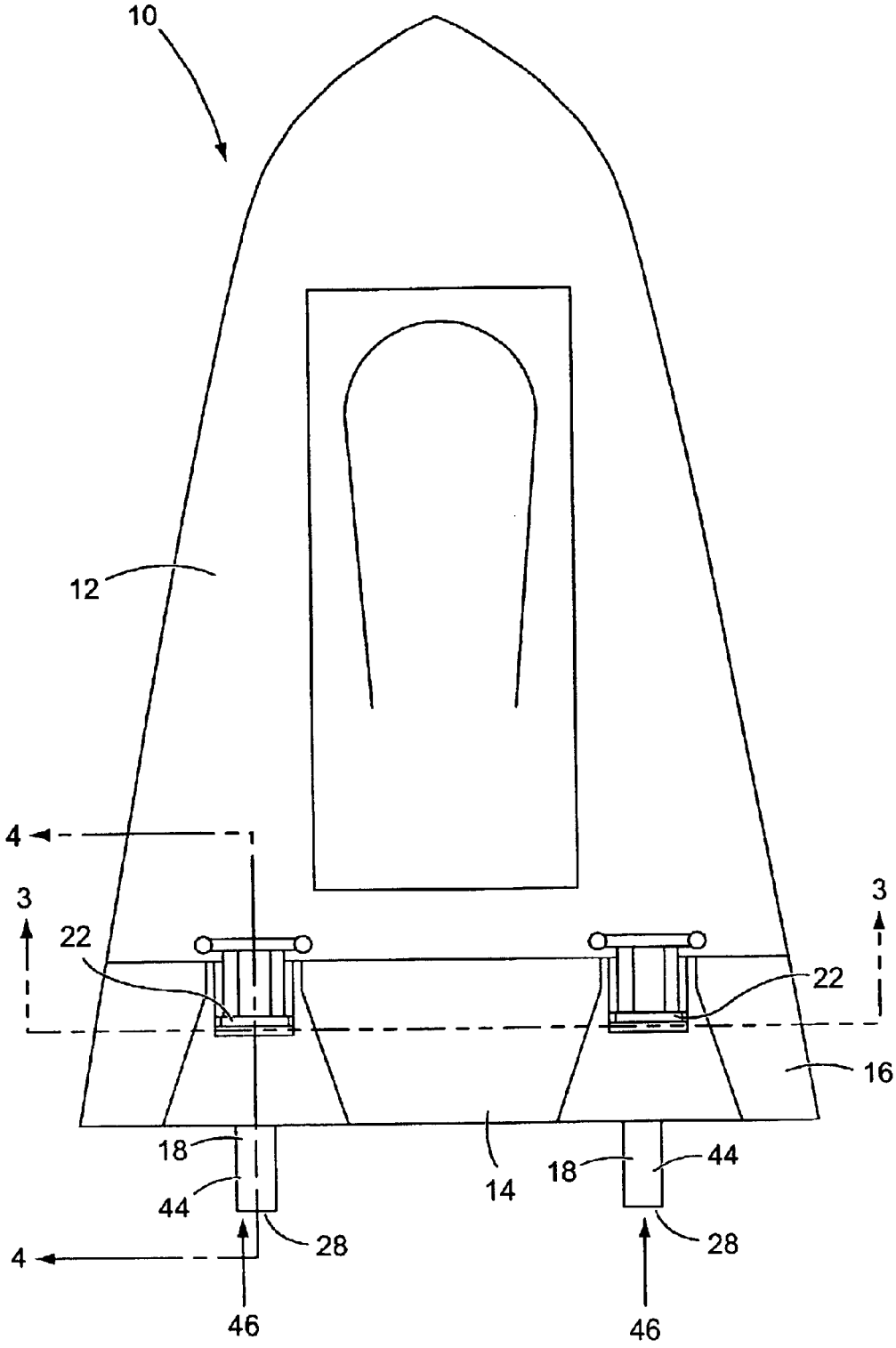
FIG. 2 is a top plan view of the watercraft shown in FIG. 1.
Figure 3:
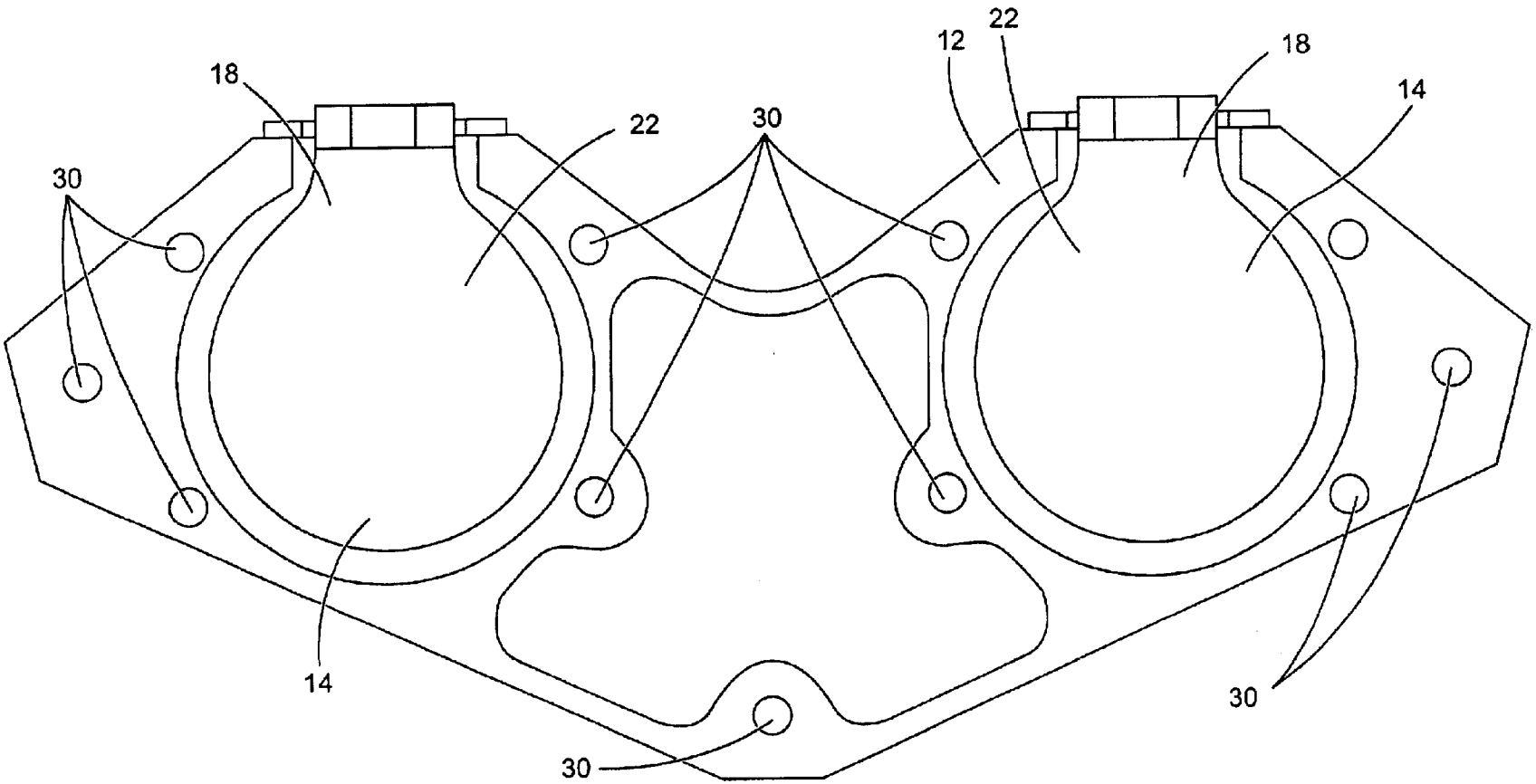
FIG. 3 is a cross-sectional view of the watercraft shown in FIG. 1, looking forward and taken about the line 3—3 of FIG. 2.

In accordance with the invention, a watercraft has been successfully produced and tested. The watercraft 10 is shown in its entirety in FIGS. 1 and 2 and is configured to float on the surface of a water environment. However, it should be appreciated that the invention could be equally utilized in conjunction with submersible watercraft without undue experimentation or modifications.

In general, the watercraft 10 comprises a main body 12 and an aft propulsion assembly 14. The main body 12 is formed of a composite glass fiber material, but could also be formed of plastic, metal, or other materials suitable for forming watercraft. The main body 12 is also aerodynamically shaped to reduce its drag as it travels through a water or other liquid environment.

The propulsion assembly 14 comprises a housing member 16 and two propulsion generating sub-assemblies 18. The propulsion generating sub-assemblies 18 are preferably identical to each other and each preferably comprises an electromagnetic actuator 20, a reciprocating member 22, a liquid chamber 24, a sealing member 26, and a liquid port 28. The housing member 16 and the main body 12, together with each other, surround most portions of the propulsion generating sub-assemblies 18 and are releasably connected to each other via a plurality of screws or bolts (not shown) inserted into attachment holes 30. The housing member 16 is preferably formed of the same material as the main body 12 and is preferably contoured such that it mates flush with the main body. Because the propulsion generating sub-assemblies 18 are identical to each other, only one of such assemblies is described herein. However, it should be appreciated that the following description of the various components of one of the propulsion generating sub-assemblies 18 applies equally to both such assemblies.

Figure 4:
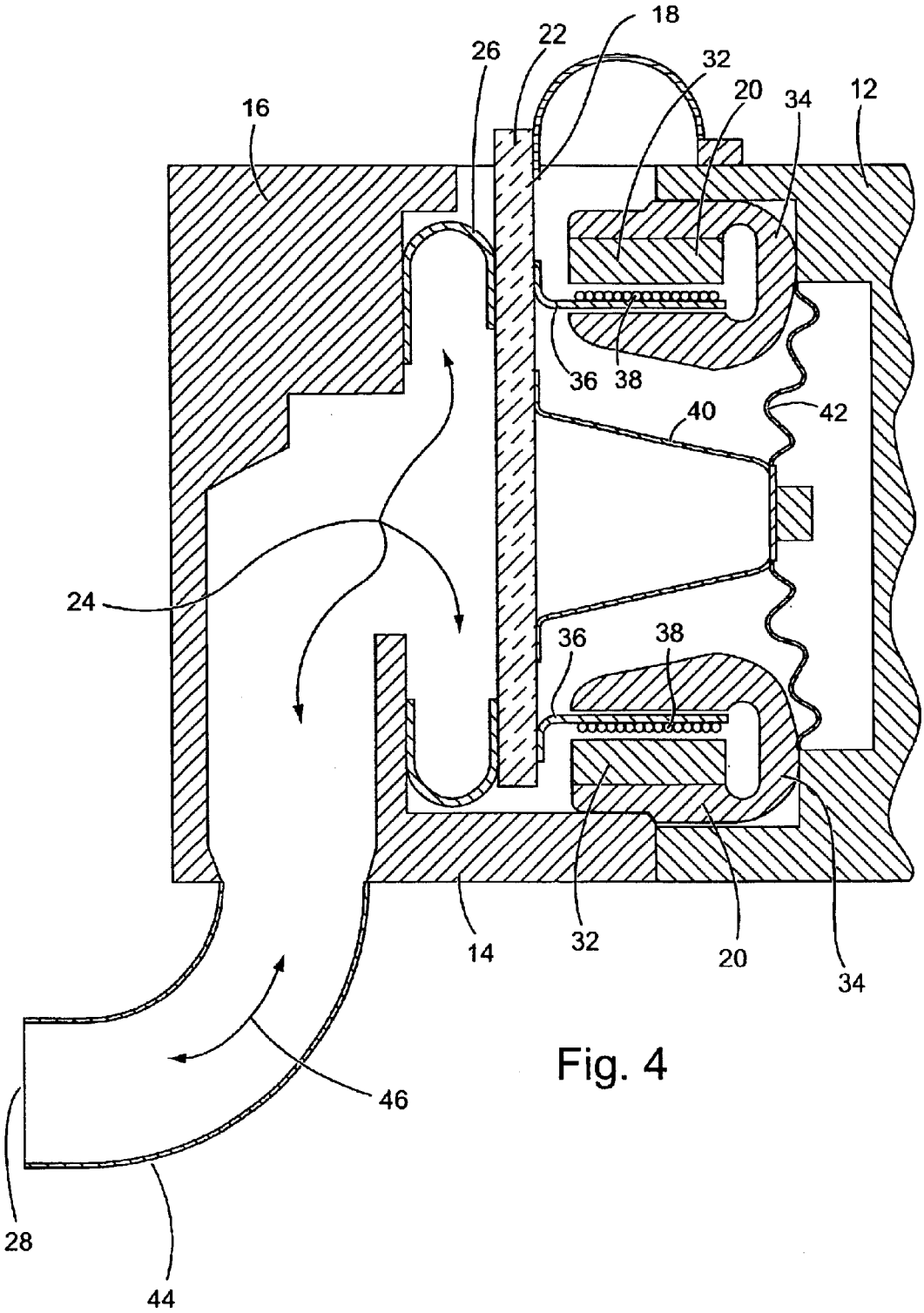
FIG. 4 is a partial cross-sectional view of the watercraft shown in FIG. 1, looking sideways and taken about the line 4—4 of FIG. 2.

The electromagnetic actuator 20 is preferably a voice coil actuator of the type well known for use in connection with acoustical loudspeakers. As is typical of such voice coils, the electromagnetic actuator 20 comprises an annular permanent magnet 32, an annular steel armature 34, and an annular driving bracket 36. An electrically conductive wire coil 38 encircles the driving bracket 36 and is electrically connected to an electrical power source and a voltage and/or frequency modulator (not shown) provided within the main body 12 of the watercraft 10. The wire coil 38 of the driving bracket 36 is positioned within the annular gap between the permanent magnet 32 and the armature 34 in a manner such that alternating current passing through the wire coil will cause the driving bracket to forcibly oscillate, horizontally as shown in FIG. 4. The driving bracket 36 is also connected to the reciprocating member 22 in a manner such that the reciprocating member oscillates therewith. The reciprocating member 22 is preferably a lightweight rigid structure preferably having a carbon fiber, honeycomb construction. A frustoconical composite former 40 and an annular flexure 42, which comprise portions of the electromagnetic actuator 20, act to maintain the proper orientation of the reciprocating member 22 and driving bracket 36 assembly as it oscillates.

The liquid chamber 24 is a cavity that is bound partially by the housing member 16 and partially by the reciprocating member 22. The annular sealing member 26 also partially bounds the liquid chamber 24 and flexibly connects the reciprocating member to the housing member 16. The sealing member 26 is preferably a bellows made of silicone-impregnated fiberglass.

The liquid port 28 is preferably an opening at the end of a nozzle 44 having an interior passageway 46 that provides a liquid connection between the liquid chamber 24 and the liquid environment adjacent the watercraft 10. The nozzle 44 preferable extends downward from beneath housing member 16 to ensure that the liquid port 28 remains underwater. Additionally, the nozzle 44 turns aft and extends axially rearward before terminating at the liquid port 28.

As the reciprocating member 22 oscillates in response to the alternating current supplied to the wire coil 38, it should be appreciated that the movement of the reciprocating member causes the internal volume of the liquid chamber 24 to repetitively increase and decrease. In use, the liquid chamber 24 is preferably completely filled with liquid and the sealing member 26 prevents such liquid from escaping out of the liquid chamber between the reciprocating member 22 and the housing member 16. Thus, the oscillation of the reciprocating member 22 causes the liquid to be forced into and out of the liquid chamber and the liquid port 28 through the passageway of the nozzle 44.

As liquid is expelled from the liquid port 28, the watercraft 10 experiences a reaction force that causes a forward thrust on the watercraft. However, when liquid is drawn in through the liquid port 28, an equal and opposite thrust is not experienced. This is because the liquid is alternatively expelled from and sucked into the liquid port 28 at rapid intervals, thereby creating expansion and compression waves. When liquid is being expelled from the liquid port 28, it has substantial momentum in the direction in which it was expelled, which is axially aft due to the configuration of the terminal portion of the nozzle 44. Conversely, when liquid is being drawn into the liquid port 28, it is drawn in both axially and radially inward from multiple directions. Thus, the opposite radial components of momentum of liquid being drawn into the liquid port negate each other, and the remaining axial component is insufficient to negate the axial momentum of the previously expelled wave of liquid. Hence, based on the law of conservation of momentum and the other well-known principles of physics, the net result of any given cycle of oscillation of the reciprocating member 22 is a forward thrust on the watercraft.

It should be appreciated that the watercraft 10 is fairly small. For example, the reciprocating member 22 is approximately 1.5 inches in general diameter, the liquid ports are only 0.25 inches in diameter, and the stroke of oscillation is less than 0.1 inches. This being said, for this watercraft 10, it has been found that oscillations of the reciprocating member 22 of between twenty and thirty hertz produce a sufficient forward thrust to propel the watercraft in its liquid environment. However, it should also be appreciated that both the stroke and the frequency of the oscillation of the reciprocating member 22 affect the thrust that is generated. Obviously, in the above-described configuration, the frequency of the oscillations of the reciprocating member 22 will be equal to the frequency of the electrical current supplied to the electromagnetic actuator 20. The stroke, on the other hand, is affected by the frequency, voltage, and/or amperage of the electrical current being supplied to the electromagnetic actuator 20. Thus, the thrust can be altered by adjusting either the frequency, the voltage, or the amperage of the electrical current supplied to the electromagnetic actuator 20.

This having been said, by being provided with two separate propulsion generating sub-assemblies 18, the watercraft 10 is steerable by reducing or increasing the thrust being generated by one such sub-assembly relative to the other. Again, this is done by adjusting the amperage, the voltage, and/or the frequency of electrical current being provided to one or both of the electromagnetic actuators 20. Thus, no rudder or other moving part is required to directionally control the watercraft 10.

In view of the above description, it should be appreciated that the invention provides a watercraft propulsion system that has virtually no noise emission and that is highly reliable due to the lack of numerous articulating parts and components.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, it should be appreciated that, although the watercraft embodiment is disclosed as having fixed nozzles that extend downward and aft, the purpose of this configuration is to ensure that the liquid port remains underwater and to reduce moving parts. However, a pivotal nozzle could also be utilized or the nozzle could be eliminated altogether, such as likely would occur if used on a submersible. Additionally, it should be appreciated that the actuator mechanism need not be a voice coil or even an electromagnetic actuator. To this end, the reciprocating member could be oscillated via a pneumatic, hydraulic, mechanical heat engine, piezoelectric, or other form of actuator. Yet further, multiple liquid ports could be connected to a single liquid chamber. Moreover, the optimum frequency of expansion and compression waves may vary based on the particular configuration of the propulsion assembly, such as the stiffness of the reciprocating member or of the sealing member. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. A method comprising:

providing a watercraft, the watercraft comprising a liquid chamber, a voice coil actuator, and at least one liquid port, the liquid chamber having an internal volume, the liquid port allowing communication of liquid between the liquid chamber and a liquid environment external to the watercraft;

using the voice coil actuator to repetitively increase and decrease the internal volume of the liquid chamber in a manner such that liquid is expelled from the liquid port into the liquid environment; and propelling the watercraft within the liquid environment via the expulsion of liquid from the liquid port.

2. A method in accordance with claim 1 wherein the liquid chamber constitutes a first liquid chamber and the liquid port constitutes a first liquid port, the step of providing the watercraft further comprising providing the watercraft with a second liquid chamber and at least one second liquid port, the second liquid port allowing communication of liquid between the second liquid chamber and the liquid environment, the method further comprising repetitively increasing and decreasing the internal volume of the second liquid chamber in a manner such that liquid is expelled from the second liquid port into the liquid environment, the method yet further comprising steering the watercraft within the liquid environment by controlling the increasing and decreasing of the internal volume of the first liquid chamber relative to the increasing and decreasing of the internal volume of the second liquid chamber.

3. A method in accordance with claim 1 wherein the step of providing the watercraft further comprises providing the watercraft with a reciprocated member that partially bounds the internal volume of the liquid chamber, the step of repetitively increasing and decreasing the internal volume of the liquid chamber being performed by moving the reciprocating member in a linearly reciprocating manner relative to other portions of the liquid chamber that also partially bound the internal volume of the liquid chamber via the voice coil actuator.

4. A method in accordance with claim 1 further comprising the step of preventing communication of liquid between the liquid chamber and the liquid environment by any means other than communication through the one liquid port during the step of propelling the watercraft within the liquid environment.

5. A method in accordance with claim 1 wherein a total amount of liquid passes out of the liquid port and into the liquid environment during the step of propelling the watercraft within the liquid environment and wherein a total amount of liquid passes into the liquid port from the liquid environment during the step of propelling the watercraft within the liquid environment, the total amount of liquid that passes out of the liquid port being equal to the total amount of liquid that passes into the liquid port.

6. A method in accordance with claim 1 wherein the step of using the voice coil actuator to repetitively increase and decrease the internal volume of the liquid chamber occurs in a manner such that repetitiveness occurs with a frequency below one-hundred hertz.

7. A method comprising:

providing a watercraft, the watercraft comprising a main body, a voice coil actuator, and a reciprocating member;

providing a water environment extemal to the watercraft, the water environment being in liquid communication with the reciprocating member of the watercraft; and propelling the watercraft through the water via alternating compression and expansion waves created by moving the reciprocating member in a linearly reciprocating manner relative to the main body of the watercraft via the voice coil actuator.

8. A method in accordance with claim 7 wherein the step of providing the watercraft further comprises provided the watercraft such that the watercraft has a liquid chamber that is partially bound by the reciprocating member, the step of propelling the watercraft through the water comprising moving the reciprocating member relative to the liquid chamber via the voice coil actuator.

9. A method in accordance with claim 7 wherein the reciprocating member is a first reciprocating member, the step of providing the watercraft further comprising providing the watercraft having a second reciprocating member in liquid communication with the water environment, the step of propelling the watercraft through the water further comprising propelling the watercraft through the water via alternating compression and expansion waves created by moving the second reciprocating member in a linearly reciprocating manner relative to the main body of the watercraft, the method further comprising steering the watercraft by adjusting the compression and expansion waves created by the first reciprocating member relative to the compression and expansion waves created by the second reciprocating member.

10. A method in accordance with claim 7 wherein the step of propelling the watercraft through the water via alternating compression and expansion occurs in a manner such that the compression and expansion waves have a frequency below one-hundred hertz.

11. A method in accordance with claim 7 wherein the step of providing the watercraft further comprises provided the watercraft such that the watercraft has a liquid port, the liquid communication between the water environment and the reciprocating member occurring solely through the liquid port.

12. A watercraft comprising:

a main body;

a liquid chamber, the liquid chamber containing liquid;

a voice coil actuator;

a reciprocating member, the reciprocating member being in communication with the liquid within the liquid chamber and being operatively connected to the main body in a manner such that the reciprocating member is linearly movable between first and second positions in a reciprocating manner relative to the main body, the voice coil actuator being operatively connected to the main body and to the reciprocating member in a manner to forcibly move the reciprocating member between the first and second positions; and a liquid passageway that creates a liquid connection between the liquid in the liquid chamber and an environment external to the main body.

13. A watercraft in accordance with claim 12 wherein the liquid chamber constitutes a first liquid chamber, the reciprocating member constitutes a first reciprocating member, the voice coil actuator constitutes a first voice coil actuator, and the liquid passageway constitutes a first liquid passageway, the watercraft further comprising a second liquid chamber, a second reciprocating member, a second voice coil actuator, and a second liquid port, the second liquid chamber containing liquid, the second reciprocating member being in communication with the liquid within the second liquid chamber and being operatively connected to the main body in a manner such that the second reciprocating member is linearly movable between first and second positions in a reciprocating manner relative to the main body, the second voice coil actuator being operatively connected to the main body and to the second reciprocating member in a manner to forcibly move the second reciprocating member between the first and second positions of the second reciprocating member, the second liquid passageway creating a liquid connection between the liquid in the second liquid chamber and the environment external to the main body.

14. A watercraft in accordance with claim 13 further comprising first and second liquid ports, the first liquid port separating the first liquid passageway from the environment external to the watercraft, the second liquid port separating the second liquid passageway from the environment external to the watercraft, each of the first and second liquid ports being fixed in orientation relative to the main body of the watercraft.

15. A watercraft in accordance with claim 12 wherein the liquid passageway is the sole liquid connection between the liquid in the liquid chamber and the environment external to the main body.

16. A watercraft in accordance with claim 12 wherein the reciprocating member partially bounds the liquid chamber.

17. A method comprising:

providing a watercraft, the watercraft comprising first and second liquid chambers, first and second reciprocated members, and first and second liquid ports, each of the first and second liquid chambers having an internal volume, the first liquid port allowing communication of liquid between the first liquid chamber and a liquid environment external to the watercraft, the second liquid port allowing communication of liquid between the second liquid chamber and the liquid environment, the first reciprocated member partially bounding the internal volume of the first liquid chamber, the second reciprocated member partially bounding the internal volume of the second liquid chamber;

repetitively increasing and decreasing the internal volume of the first liquid chamber in a manner such that liquid is expelled from the first liquid port into the liquid environment by moving the first reciprocating member in a linearly reciprocating manner relative to other portions of the first liquid chamber that also partially bound the internal volume of the first liquid chamber, the linear reciprocation of the first reciprocating member having a stroke;

repetitively increasing and decreasing the internal volume of the second liquid chamber in a manner such that liquid is expelled from the second liquid port into the liquid environment by moving the second reciprocating member in a linearly reciprocating manner relative to other portions of the second liquid chamber that also partially bound the internal volume of the second liquid chamber, the linear reciprocation of the second reciprocating member having a stroke;

propelling the watercraft within the liquid environment via the expulsion of liquid from the first and second liquid ports; and steering the watercraft within the liquid environment at least partially by causing the stroke of the linear reciprocation of the first reciprocating member to be different from the stroke of the linear reciprocation of the second reciprocating member throughout a given period of time.

18. A method in accordance with claim 17 wherein the step of repetitively increasing and decreasing the internal volume of the first liquid chamber occurs in a manner such that the linear reciprocation of the first reciprocating member has a frequency and the step of repetitively increasing and decreasing the internal volume of the second liquid chamber occurs in a manner such that the linear reciprocation of the second reciprocating member has a frequency, and wherein the step of steering the watercraft within the liquid environment occurs at least partially by causing the frequency of the linear reciprocation of the first reciprocating member to be different from the frequency of the linear reciprocation of the second reciprocating member.

* * * * *